United States Patent [19]

Koiso et al.

[11] 4,354,763

[45] Oct. 19, 1982

[54] DRY-TYPE DEVELOPING DEVICE

[75] Inventors: Junichi Koiso; Akihiko Tamura; Isao Ikemoto, all of Hachioji, Japan

[73] Assignee: Konishiroku Photo Industry Co., Ltd., Japan

[21] Appl. No.: 210,138

[22] Filed: Nov. 24, 1980

[30] Foreign Application Priority Data

Nov. 26, 1979 [JP] Japan ..... 54-162686[U]

[51] Int. Cl.[3] ..... G03G 15/09

[52] U.S. Cl. ..... 366/181; 366/158; 118/612; 118/658; 355/3 DD

[58] Field of Search ..... 366/156, 158, 300, 181; 118/612, 653, 654, 655, 656, 657, 658; 222/DIG. 1; 355/3 DD

[56] References Cited

U.S. PATENT DOCUMENTS 3,543,720 12/1970 Drexler ..... 355/3 DD
4,173,405 11/1979 Swapceinski et al. ..... 118/657 X
4,177,757 12/1979 Murakawa et al. ..... 118/658
4,261,290 4/1981 Yamashita et al. ..... 118/658

FOREIGN PATENT DOCUMENTS 1202138 9/1965 Fed. Rep. of Germany ..... 118/653

*Primary Examiner*—Philip R. Coe
*Assistant Examiner*—Joseph M. Pitko
*Attorney, Agent, or Firm*—Jordan B. Bierman; Linda Bierman

[57] ABSTRACT

An improved developing device includes a rotatable sleeve, a reservoir from which developer is available for image development, a hopper containing fresh replenishment toner, a plate for scraping used developer from the sleeve and for directing it into a conduit in which it is mixed with fresh replenishment toner, and at least an opening in the conduit from which replenished developer comprising used developer mixed with fresh toner is returned to the reservoir in a substantially uniformly mixed condition for use in subsequent image development.

3 Claims, 2 Drawing Figures

DRY-TYPE DEVELOPING DEVICE

BACKGROUND OF THE INVENTION

The present invention relates to an improvement in developing devices for an electrostatic recording device—such as an electrophotographic copying machine—wherein a dry-type developer comprising toner and carrier is used.

In a developing device using dry-type developer comprising toner and carrier, the developer component that is mainly consumed in the copying operations is toner, and thus only toner need generally be replenished in the developer mixture. In conventional developing devices, toner is supplied directly into the developing device from a replenishing hopper to accomplish the replenishment operation. Despite the presence of a simple mixing device, it takes time for the added or replenishment toner to mix with the developer in the developing device; thus, when the developer is then successively conveyed by a developer carrying means (such as a sleeve well known in the art) to the photosensitive member, the conveyed developer occassionally remains in an insufficiently mixed or undispersed state causing an unstable toner density balance for copying.

SUMMARY OF THE INVENTION

The present invention offers a developing device wherein the aforesaid trouble can be appreciably decreased in that mixing of the replenishment toner with the developer in the developing device is accomplished quickly, surely and uniformly. The developing device according to the present invention is characterized in its provision of a mixing and replenishing means that replenishes toner to the developer in the developing device after first mixing the developer which has completed the developing process with fresh toner from the replenishing hopper.

Since in the developing device of the present invention, the used developer is mixed with fresh replenishment toner in advance of its remixture with the main developer supply, the replenished toner and the main developer supply in the developing device adapt themselves to each other and are therefore quickly and readily mixed to uniformity for circulation in the developing device. A uniform distribution of carrier and toner can thus always be obtained for excellent developing quality.

Furthermore, if a device for both mixing and conveying—such as a screw-conveyor—is used as the mixing and replenishing means in the developing device of the present invention, toner replenishment can be accomplished uniformly and smoothly along the entire width of the developing device, the width of the replenishing device being narrower than that of the developing device to enable substantial miniaturization of the copying machine. If, however, only toner is conveyed by the screw-conveyor, it is difficult to render a smooth and uniform supply of toner along the entire width of the developing device because toner alone has a low flowability and tends to cohere with the influence of temperature; in an extreme case, the toner may cohere in the distribution tube in which the screw-conveyor is provided. Such trouble can likewise be solved by the construction of the device according to the present invention in which toner can be replenished smoothly and uniformly along the entire width of the developing device without cohering in the distribution tube.

The present invention will be illustrated as follows with the aid of the drawings.

BRIEF DESCRIPTION OF THE PREFERRED EMBODIMENT

Figure 1:
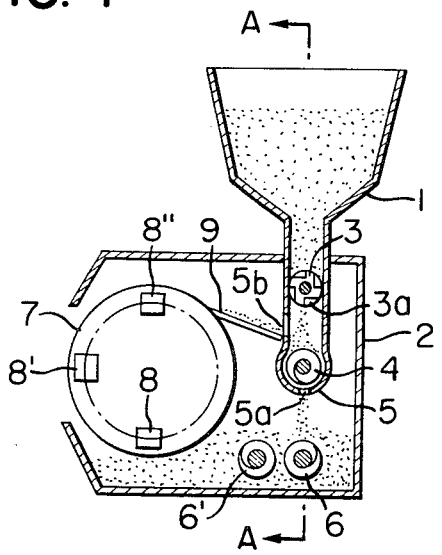
FIG. 1 is a sectional side view of the main portion of a device constructed in accordance with the present invention.
Figure 2:
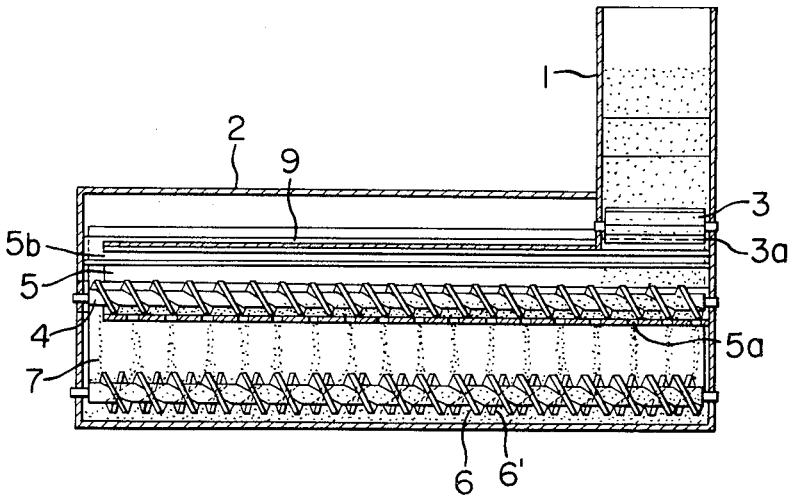
FIG. 2 is a sectional view taken along the arrows A—A in FIG. 1.

A magnetic-brush developing device is shown by FIGS. 1 and 2 as an embodiment of the present invention. Referring to the drawing, reference numeral 2 designates a casing or main body capable of storing developer—consisting chiefly of toner particles and carrier particles—at its lowermost portion, and having an opening for the developing process as described hereinafter. Reference numerals 6 and 6' denote a pair of stirrers disposed parallel to each other at the bottom of casing 2, the stirrers extending along the lengthwise direction of the casing and being controlled for reverse rotation with respect to each other. Numeral 7 designates a rotatable sleeve formed of non-magnetic, electrically conductive materials for carrying the developer to a developing position at which a portion of its peripheral surface is disposed adjacent or proximate the opening (no reference symbol) in casing 2 mentioned above. The elements designated 8, 8' and 8'' are magnets disposed within the sleeve, radially and fixedly spaced from its inner surface, whereby the developer is attached or attracted onto the exterior surface of the sleeve for circulation with the sleeve when the same is operatively rotated. Main magnet 8' is positioned at the center of the developing position opening. The relative positioning of the magnets or their magnetic poles can be readily determined.

Numeral 9 refers to a scraping means (herein a plate) for scraping from sleeve 9 developer which has completed the development process for an electrostatic latent image formed on a photosensitive member (not shown) at the development position opening. To assure the scraping operation, one end of scraping means 9 is disposed in contact with the surface of the sleeve or is at least closely positioned to the latter. In addition, the scraping means is inclined so that the scraped off developer smoothly flows along the upper surface thereof.

A toner hopper 1 positioned at one side of casing 2 of the developing device comprises a storage chamber (no reference symbol) projecting from casing 2 and a duct portion (no reference symbol) projecting into the casing, the lower portion 5 of the duct portion being semicircularly configured. The duct portion of hopper 1 carries therewithin a rotatable replenishing roller 3 so shaped that it blocks up the narrowed area of the duct portion; the surface of roller 3 includes a plurality of grooves 3*a* arranged in the direction of its width such that toner entering the grooves is supplied to the duct lower portion 5 with the rotation of replenishing roller 3.

A mixing and conveying means 4 consisting of a screw-conveyor provided below roller 3 at the semi-circular portion 5 of toner hopper 1 is of a length similar to that of sleeve 7 and stirrers 6, 6', as shown in FIG. 2. The semi-circular portion 5 (hereinafter the distribution cylinder) of toner hopper 1 is extended so as to enclose or cover mixing and conveying means 4 along its length. With this construction, a passage receives a supply of toner from replenishing roller 3—which is in turn in communication with the toner hopper. The bottom part of distribution tube 5 includes a plurality of holes 5*a* distributed over its entire length and through which the replenished toner mixed and conveyed by mixing and conveying means 4 is supplied to the interior of casing 2. The duct portion of hopper 1 is provided with an opening 5*b* for receiving toner scraped from sleeve 7 by scraping means 9, opening 5*b* accordingly being formed on a portion of the hopper duct having a length similar to that of mixing and conveying means 4 (FIG. 2). In other words, sleeve 7, scraping means 9, and that part of the duct portion of hopper 1 containing mixing and conveying means 4, opening 5*b*, and holes 5*a*, are all of substantially the same length. Opening 5*b* is located between the position where roller 3 is held and the lowest position at which mixing and conveying means 4 is disposed, and the free end of scraping means or plate 9 faces opening 5*b*.

In the illustrated example, the mixing and replenishing means is composed of mixing and conveying means 4, distribution cylinder 5, and scraping means 9 which serves to supply used toner into distribution cylinder 5 through opening 5*b*.

In the developing device of the present invention, the used developer supplied via scraping means 9 is added to fresh toner supplied from toner hopper 1 and they are mixed by mixing means 4 and thereafter replenished into the main body of developing device 2 through drop holes 5*a* of distribution cylinder 5. The replenished mixture and the developer already present in the case 2 readily adapt themselves to each other and accordingly quickly and uniformly mix together without flooding the casing or contaminating the recording device or copying machine interior and staining the recording sheet. Even if the copying machine is miniaturized as in the illustrated example by use of a screw-conveyor and by making the width of toner hopper 1 narrower than that of casing 2, the fresh toner is mixed with the used developer in mixing and conveying means 4 resulting in a mixture of excellent flowability to enable smooth and uniform replenishment over the entire width of the developing device without any blocking of or in distribution cylinder 5.

The illustrated example provides only one embodiment in accordance with the present invention, and many modifications are possible. Thus, the toner hopper may be of the same supplying width as the main body of the developing device and, particularly in such a case, the mixing and replenishing means can be of the type having its stirring blades in parallel with a width-wise extending axis instead of employing a screw-conveyor. Furthermore, the mixing and conveying means may comprise a belt or rope conveyor moved rotatably in the distribution cylinder so that the edge of the scraping blade installed on and perpendicular to the belt or rope is maintained in contact with the side of the distribution cylinder.

What is claimed is:

1. In a developing device for an electrostatic recording machine utilizing a developer of toner and carrier and wherein at least a portion of the toner is removed from the developer during development, the developing device including a magnetic brush sleeve for carrying developer on its surface and being partially immersed in a reservoir of developer, an apparatus for replenishing the developer by restoring toner thereto to enable its subsequent reuse for development and comprising:

a toner hopper for containing a supply of fresh toner and including a vertically extending duct into which fresh toner is dispensed and an opening defined in said duct;

elongated mixing and conveying means disposed in said duct at its lowermost portion and below said opening therein so that fresh toner dispensed from said hopper drops onto said mixing and conveying means, and operative to distribute along its entire length the fresh toner dropping thereon;

scraping means for removing used developer from the sleeve and for directing the used developer into said duct through said opening therein and directly onto said mixing and conveying means along its entire length for mixture thereby with the fresh toner to replenish the developer for subsequent reuse; and said duct further including a plurality of openings at its lowermost portion below and along the length of said mixing and conveying means and through which replenished developer from said mixing and conveying means is returned to the reservoir after mixing by said mixing and conveying means for use in subsequent development.

2. In a developing device in accordance with claim 1, said mixing and conveying means comprising a screw conveyor.

3. In a developing device in accordance with claim 1, the fresh toner being dispensed from said supply thereof into said duct and onto said mixing and conveying means along only a portion of the length of said mixing and conveying means which is operative to distribute the fresh toner along its entire length.

* * * * *